United States Patent [19]

Ishibashi et al.

[11] 3,933,601

[45] Jan. 20, 1976

[54] ELECTROPLATING METHOD AND APPARATUS

[75] Inventors: Motochika Ishibashi; Takahiko Inuzuka; Tetsuo Maegawa, all of Amagasaki, Japan

[73] Assignee: Mitsubishi Denki Kabushiki Kaisha, Tokyo, Japan

[22] Filed: Mar. 13, 1975

[21] Appl. No.: 558,137

[30] Foreign Application Priority Data

Mar. 13, 1974 Japan ..... 49-29306

[52] U.S. Cl. ..... 204/25; 204/273; 204/277

[51] Int. Cl.[2] ..... C25D 7/04; C10G 17/06

[58] Field of Search ..... 204/25, 273, 222, 212, 204/277

[56] References Cited

UNITED STATES PATENTS

| | | | |
|---|---|---|---|
| 1,884,512 | 10/1932 | Ballard | 204/25 |
| 2,155,392 | 4/1939 | Ballard | 204/25 |
| 2,435,872 | 2/1948 | Coulson | 204/25 |
| 2,702,260 | 2/1955 | Massa | 204/273 |
| 2,744,860 | 5/1956 | Rines | 204/222 |
| 2,888,939 | 6/1959 | Nitsche | 204/222 |
| 3,647,646 | 3/1972 | Tucker et al. | 204/273 |

*Primary Examiner*—T. M. Tufariello

*Attorney, Agent, or Firm*—Oblon, Fisher, Spivak, McClelland & Maier

[57] ABSTRACT

An electroplating method is disclosed and includes the rotation of a substrate, submerged within an electrolytic solution, under the application of ultrasonic waves, and the ejection of the electrolytic solution containing bubbles in a direction opposite the direction of rotation of the substrate. The electroplating apparatus for electroplating the substrate submerged within the electrolytic solution disposed within an electrolytic cell applies ultrasonic waves to the solution and additionally includes a driving device for rotating the substrate, a bubble generator for entraining bubbles within the electrolytic solution, and an ejector for ejecting the electrolytic solution containing the bubbles generated by means of the bubble generator in a direction which is opposite to the direction of rotation of the substrate.

16 Claims, 4 Drawing Figures

ELECTROPLATING METHOD AND APPARATUS

BACKGROUND OF THE INVENTION

1. Field of the Invention

The present invention relates generally to a method and apparatus for electroplating, and more particularly to an electroplating method which is particularly adaptable for a long workpiece, such as, for example, a roller by applying an ejected flow of the electrolytic solution containing entrained bubbles toward the substrate and under the influence of ultrasonic energy, and an apparatus for practicing such an electroplating method.

2. Description of the Prior Art

It has been conventional to conduct an electroplating process wherein a substrate to be electroplated has been rotated so as to impart uniform electrodeposition thereto and to obtain a smooth surface in the instance of a thick boundary layer portion of the electrolytic solution disposed about the substrate is somewhat entrained and rotated by means of the wave movement of the solution generated as a result of the rotation of the substrate, and in the same direction as such substrate rotation, whereby non-uniform electrodeposition is in fact disadvantageously produced which serves to form a wave pattern type electrodeposition upon the surface of the substrate.

Accordingly, it has been necessary to conduct intermediate abrasive operations in order to rectify such defects.

SUMMARY OF THE INVENTION

Accordingly, it is an object of the present invention to provide an electroplating method for preparing a product, such as, for example, a roller which characteristically has a favorable luster and smooth surface and which may be obtained under high electroplating speeds and for various kinds of metals, without the necessity of conducting intermediate abrasive operations.

Another object of the present invention is to provide an electroplating method wherein the ejecting direction of the electrolytic solution is variable so as to result in an optimum flow of the ejected electrolytic solution to the substrate depending upon the size of the substrate.

Still another object of the present invention is to provide an electroplating method wherein the rate of the ejected electrolytic solution is variable so as to result in an optimum flow rate and uniform distribution of the electrolytic solution depending upon the size and the rotary speed of the substrate.

Yet another object of the present invention is to provide an apparatus for practicing the electroplating methods of the present invention.

The foregoing objectives have been achieved according to the present invention through the provision of an electroplating method which comprises the steps of rotating a substrate submerged within an electrolytic solution while under the influence of ultrasonic waves and ejecting the electrolytic solution, which contains bubbles, in a direction which is opposite the direction of rotation of the substrate, whereby the fluctuation of the electrodeposition, caused by the wave movement of the electrolytic solution depending upon the rotation of the substrate, is prevented. The time for accomplishing the electroplating is also remarkably shortened and the formation of a pattern normally caused by the standing wave of the ultrasonic waves is prevented so as to impart an electrodeposition layer to the substrate having excellent hardness, abrasion resistance, adhesiveness, luster, and a dense structure which are characteristic properties of an ultrasonic electroplating process.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF A PREFERRED EMBODIMENT

Figure 1:
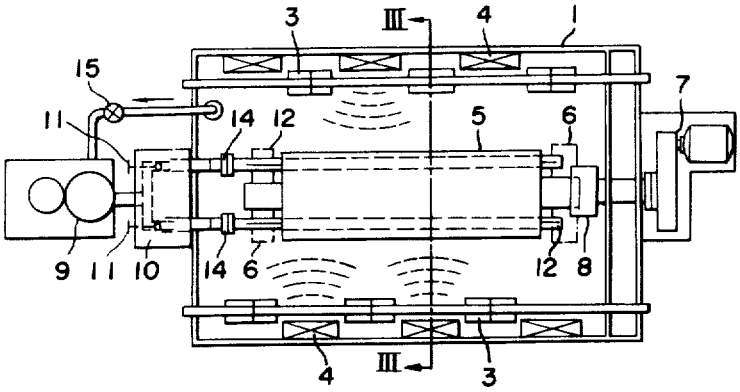
FIG. 1 is a plan view of one embodiment of an electroplating apparatus constructed in accordance with the present invention and showing its cooperative parts.
Figure 2:
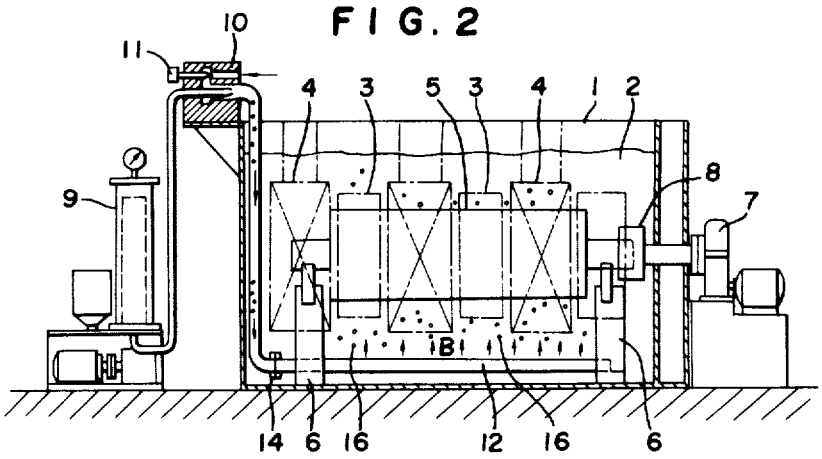
FIG. 2 is a front, partial sectional view of the apparatus of FIG. 1.
Figure 3:
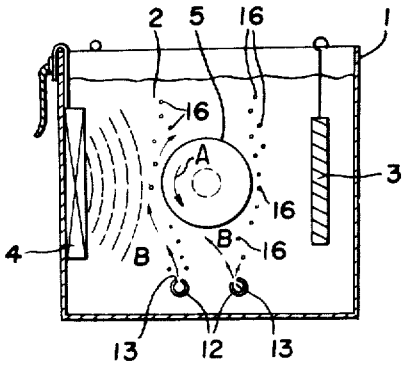
FIG. 3 is a cross-sectional view of the apparatus of FIG. 1 taken along the line of III—III of FIG. 1.

Referring now to the drawings, and more particularly to FIGS. 1–3 thereof, one embodiment of the present invention will now be described, the FIGURES illustrating a high speed electroplating apparatus which employs ultrasonic waves for imparting thick depositions of the electroplated material to and upon a substrate, such as, for example, a long roller. An electrolytic cell 1 is provided within which an electrolytic solution 2 is disposed and a plurality of anodes 3 and ultrasonic generators 4 are alternatively disposed interiorly of the electrolytic cell 1. A substrate, such as, for example, a long roller 5 is supported upon a suitable support mechanism 6 also disposed within the electrolytic cell 1 and a driving device 7, for rotating the substrate 5 in the direction of the arrow line A, (see FIG. 3), through means of a suitable coupling 8 is also provided.

Figure 4:
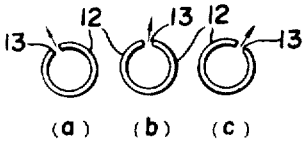
FIG. 4 is a schematic view for showing the variable positions of the ejecting tubes.

A filter 9 for filtering the electrolytic solution 2, as the same is recycled, is disposed exteriorly of cell 1 and a bubble generator 10 is disposed adjacent filter 9 and is interposed between filter 9 and cell 1 so as to generate bubbles into the electrolytic solution which has been filtered through the filter 9, the bubble generator entraining bubbles within the filtrate. Needle-shaped valves 11 of the bubble generator 10 control the feed rate of the air and the size of the bubbles, and a plurality of ejecting tubes are disposed along the bottom portion of cell 1 and below substrate 5. The tubes are an integral part of the recycling flow path of the electrolytic solution 2 and the ejecting tubes eject the filtered electrolytic solution, which contains the bubbles entrained by means of the bubble generator 10, to the substrate in a direction which is substantially opposite the direction of rotation of the substrate 5. In order to determine such direction of the bubble generation, slit type ejection apertures 13 are formed within the ejecting tubes 12 as best shown in FIG. 4. A suitable control device 14 is provided in conjunction with tubes 12 for controlling the rotation of the same and the angular disposition of slits 13 of tubes 12 so as to control the angle of ejection of the ejecting tubes 12 as best seen in FIG. 4, and a flow rate control valve 15 is disposed in conjunction with the inlet side of the filter 9 so as to control the flow rate of the electrolytic solution being recycled and ejected from the ejecting tubes 12.

Within the apparatus having the above-noted structure, ultrasonic waves are applied to the electrolytic cell, and the ion concentration gradient and polarization around the anodes and the substrate are decreased by means of the ultrasonic vibrations and the stirring effect of the resulting cavitation, whereby the maximum allowable current density can be remarkably increased and excellent properties can be imparted to the electrodeposited product. In addition, the current efficiency is substantially increased and the uniformity of the electrodeposition is substantially improved, the porosity being decreased while dense crystalline particles are formed and consequently rapid electroplating is attained.

It is noted that the bubbles are entrained within the electrolytic solution 2, filtered through the filter 9, by means of the bubble generator 10 and that the electrolytic solution 2 containing the bubbles is ejected from the ejecting tubes 12, as shown by the arrow lines B of FIGS. 2 and 3, so as to form a substantially uniform ejected flow. In this case, the bubbles are uniformly distributed within the electrolytic solution 2 as shown in FIG. 3, whereby the bubbles 16 float upwardly in the form of a curtain. However, it is also noted that the ultrasonic waves generated by means of the ultrasonic generators 4 cause the bubbles 16 to be irregularly deflected whereby the formation of standing waves normally caused by means of the ultrasonic waves is prevented so as to provide an electrodeposition having excellent properties, such as, for example, hard luster and smooth surface, wherein there are no striped or spotted patterns which could normally be produced by means of stationary waves.

Within the apparatus, as shown in FIG. 3, the electrolytic solution 2 containing bubbles 16 is uniformly ejected toward the substrate 5 from the ejecting tubes 12 in the direction of the arrow lines B which direction is opposite that of the rotation of the substrate 5 as illustrated by the arrow line A. In this manner, the wave-movement of the electrolytic solution 2 around the substrate 5, and relative to the rotary direction of the substrate, can be prevented whereby a fluctuation in the electrodeposition normally caused by the wave-movement of the electrolytic solution can also be prevented.

The control device 14 can of course control the angular orientation of the slits 13 of the tubes 12 and thereby control the angle of the ejected flow of the recycled solution from the ejecting tubes 12 as best shown in FIG. 4. Accordingly, the optimum ejecting position of the solution relative to the substrate can be suitably selected by controlling the angle of the ejected flow depending upon the size of the substrate 5. Similarly, the flow rate of the electrolytic solution from the ejecting tubes 12 can be controlled by means of the flow rate control valve 15, or alternatively, by controlling the rotary speed of the substrate 5, whereby the electrolytic solution is ejected at an optimum flow rate relative to the angular velocity of the substrate so as to prevent any disadvantages normally caused by wave-movements of the electrolytic solution around the substrate.

It is also incidentally noted that the ejected electrolytic solution is recycled through the filtering apparatus back into the electrolytic cell and that the bubbles are also entrained within the filtering passageway and accordingly, the filtering operation, the bubble entraining operation, and the ejecting operation are economically performed. The bubbles can be entrained within the electrolytic solution as the same passes through the recycling passageway, however, it is also possible to entrain the bubbles within the solution by directly injecting air into the electrolytic solution within the electrolytic cell by means of an air injector so disposed as to preferably discharge into the ejected flow of the electrolytic solution.

It is to be noted further that the bubbles can be formed by using air as well as another inert gas, it being remembered that the direction of the ejected electrolytic solution is to be maintained opposite the direction of rotation of the substrate.

Obviously, many modifications and variations of the present invention are possible in light of the above teachings. It is to be understood therefore that within the scope of the appended claims the present invention may be practiced otherwise than as specifically described herein.

What is claimed as new and desired to be secured by Letters Patent of the United States is:

1. An electroplating method which comprises the steps of:
   - rotating a substrate submerged within an electrolytic solution and under the influence and application of ultrasonic waves;
   - entraining bubbles within a portion of said solution; and
   - causing said portion of said electrolytic solution to be ejected toward said substrate in a direction substantially opposite the direction of rotation of the substrate.

2. The electroplating method according to claim 1, wherein:
   - the direction of ejection of said electrolytic solution is changeable with respect to said substrate so as to provide optimum flow conditions.

3. The electroplating method according to claim 1, wherein:
   - the flow rate of said ejected electrolytic solution is changeable so as to provide an optimum flow rate.

4. The electroplating method according to claim 1 wherein:
   - said electrolytic solution is recycled out of and back into an electrolytic cell; and
   - said bubbles are entrained within a recycling passageway of said electrolytic solution.

5. The electroplating method according to claim 4 wherein:
   - said solution is passed through said recycling passageway of said electrolytic solution for filtering said solution.

6. An electroplating apparatus for electroplating a substrate submerged within an electrolytic solution disposed within an electrolytic cell and under the application and influence of ultrasonic waves, comprising:
   - driving means for rotating said substrate;
   - bubble generator means for entraining bubbles within said electrolytic solution; and
   - ejector means for ejecting a portion of said electrolytic solution toward said substrate in a direction opposite the direction of rotation of said substrate.

7. The electroplating apparatus according to claim 6, which further comprises:

flow rate control valve means for controlling the flow rate of said electrolytic solution ejected from said ejector means.

8. The electroplating apparatus according to claim 6, which further comprises:

control means for controlling the angle of said ejection of said electrolytic solution from said ejector means to said substrate.

9. The electroplating apparatus according to claim 6, wherein:

said ejector means includes an ejecting tube having ejection apertures disposed toward said substrate.

10. The electroplating apparatus according to claim 9 which further comprises:

control means for controlling the angle of said ejection of said electrolytic solution from said apertures of said ejector means toward said substrate.

11. The electroplating apparatus according to claim 9 wherein:

said ejecting tube is disposed below said substrate within said electrolytic solution.

12. The electroplating apparatus according to claim 9 which further comprises:

filter means for filtering said electrolytic solution as said solution is recycled through said apparatus.

13. The electroplating apparatus according to claim 12 wherein:

said ejecting tube is disposed below said substrate within said electrolytic solution.

14. The electroplating apparatus according to claim 12 which further comprises;

control means for controlling the angle of said ejection of said electrolytic solution from said apertures toward said substrate.

15. The electroplating apparatus according to claim 12 which further comprises:

flow rate control valve means for controlling the flow rate of said electrolytic solution ejected from said ejecting tube, which is disposed upon the inlet side of said filter means.

16. The electroplating apparatus according to claim 12 wherein:

said ejection apertures of said ejecting tube comprise slits.

* * * * *